United States Patent [19]

Morimoto et al.

[11] Patent Number: 4,552,719

[45] Date of Patent: Nov. 12, 1985

[54] METHOD OF SINTERING STAINLESS STEEL POWDER

[75] Inventors: Toru Morimoto; Tsuyoshi Ohsaki; Toshio Ohkawa; Masahito Fujita, all of Narashino, Japan

[73] Assignee: N.D.C. Co., Ltd., Chiba, Japan

[21] Appl. No.: 528,005

[22] Filed: Aug. 31, 1983

Related U.S. Application Data

[63] Continuation of Ser. No. 212,462, Dec. 3, 1980, abandoned.

[51] Int. Cl.[4] ..... B22F 1/00; B22F 3/10

[52] U.S. Cl. ..... 419/2; 419/23; 419/32; 419/39; 419/46; 419/47; 419/54

[58] Field of Search ..... 419/2, 31, 46, 39, 57, 419/58, 23, 32, 47

[56] References Cited

U.S. PATENT DOCUMENTS

| | | | |
|---|---|---|---|
| 2,361,443 | 11/1944 | Wulff | 419/23 |
| 2,920,958 | 1/1960 | Bergh | 419/46 |
| 3,223,523 | 12/1965 | Adler | 419/23 |
| 3,899,319 | 8/1975 | Lindskog et al. | 419/23 X |
| 4,011,077 | 3/1977 | Kaufman | 419/32 |
| 4,251,273 | 2/1981 | Smith et al. | 419/32 X |
| 4,283,465 | 8/1981 | Morimoto et al. | 419/2 X |
| 4,393,563 | 7/1983 | Smith | 419/32 X |

FOREIGN PATENT DOCUMENTS

| | | |
|---|---|---|
| 779949 | 7/1957 | United Kingdom . |

*Primary Examiner*—Edward A. Miller
*Assistant Examiner*—Matthew A. Thexton
*Attorney, Agent, or Firm*—Sughrue, Mion, Zinn, Macpeak & Seas

[57] ABSTRACT

A stainless steel powder is mixed with at least a Ni—Mn and a Ni—Cr powder, and the powder mixture is formed by loose packing into a required configuration. The powder mixture is sintered in a non-oxidizing atmosphere at the melting point of the Ni—Mn powder or at a higher temperature thereby to obtain a porous body.

1 Claim, No Drawings

METHOD OF SINTERING STAINLESS STEEL POWDER

This is a continuation of application Ser. No. 212,462, filed Dec. 3, 1980, now abandoned.

BACKGROUND OF THE INVENTION

1. Field of the Invention

The present invention relates to method for manufacturing a porous body of a stainless steel powder by sintering the stainless steel powder and, more particularly to a method which permits sintering of the stainless steel powder without applying any pressure to the stainless steel powder at a temperature below its melting point to obtain a porous body which is excellent in mechanical strength, corrosion resistance and heat resistance.

2. Description of the Prior Art

Heretofore, a porous body obtained by sintering an iron powder, copper powder or the like has been used as an oil, water or similar liquid filter, but in recent years the porous body is receiving particular attention as a sound-absorbing material since the porous structure of the porous body has excellent sound-absorbing properties. Although the porous body is such a useful industrial material, porous bodies now placed on the market are sintered bodies of iron, copper and like powders and these sintered bodies are poor in corrosion resistance and heavy, and hence limited in use. To avoid the abovesaid defects, the present inventors have previously proposed a method for sintering a porous body of a lightweight aluminum powder. The porous body obtained by this method has a pore ratio of, for example, 40% or more and exhibits very excellent sound-absorbing properties but is poor in heat resistance and in mechanical strength.

In contrast thereto, a porous body of a stainless steel powder is excellent mechanical properties and rich in corrosion resistance and in heat resistance, and hence is preferred as a sound-absorbing material. Since the stainless steel powder has a large hardness of, for example, $H_{RC}$40 to 50 or so and has a high sintering temperature, however, the sintering method itself poses a problem. According to a prior art method for sintering the stainless steel powder, the powder is heat treated prior to sintering, to reduce its hardness to less than $H_{RC}$40, and the powder is formed by rolling into a compact body, which compact body is then sintered at such a high temperature as 1300° to 1400° C. This conventional method involves preheat treatment of the stainless steel powder and, moreover, the high sintering temperature requires expensive sintering facilities and raises the sintering cost and, moreover, a porous body of the stainless steel powder can not be obtained by the conventional method; accordingly, there is a strong demand for improvement of the sintering method.

The present inventors had make a study of a sintering method which would permit sintering of the stainless steel powder at a relatively low temperature regardless of the shapes of powder particles to obtain a porous body of excellent mechanical strength and corrosion resistance. As a result of their study, they have proposed a method in which one or more of Cu-Mn or Ni-Mn alloy powders are mixed in the stainless steel powder and the powder mixture is loosely packed into a required configuration and sintered in a non-oxidizing atmosphere at the melting point of the alloy powder or at a higher temperature. With this method, the sintering temperature is relatively low and the pore ratio of the sintered body can freely be adjusted.

SUMMARY OF THE INVENTION

Accordingly, it is an object of the present invention to provide a stainless steel sintering method which permits sintering a stainless steel powder at a relatively low temperature to obtain a porous body of excellent mechanical strength and corrosion resistance.

Briefly stated, according to the present invention, at least a Ni-Mn and a Ni-Cr powder are mixed in the stainless steel powder and the powder mixture is loosely packed into a required configuration and then sintered in a non-oxidizing atmosphere at the melting point of the Ni-Mn powder or at a higher temperature.

DESCRIPTION OF THE PREFERRED EMBODIMENTS

A detailed description will hereinafter be given of the sintering method of the present invention.

At first, a Ni-Mn powder and a Cr-Mn powder are mixed in a stainless steel powder. In this case, the stainless steel powder used may be an ordinary austenite or ferrite system stainless steel powder. The stainless steel powder may also be preheated to reduce its hardness.

Next, the powder mixture is loosely packed into a required configuration, for example, by pouring it into a vessel, or in the case where the stainless steel powder is heat-treated, the powder is formed into the required configuration without applying any pressure to the powder. Thereafter, the formed body is sintered in a non-oxidizing atmosphere such, for instance, as a hydrogen atmosphere, at the melting point of the Ni-Mn powder or at a higher temperature without applying any pressure to the formed body. By such sintering, as the Ni-Mn powder is molten, the Cr-Ni powder is molten and the powder mixture is sintered, with one part thereof remaining in liquid phase.

Whether it is of the ferrite or the austenite system, the stainless steel powder contains at least 12% or more of chromium and the powder particles are each covered with an chromium oxide ($Cr_2O_3$) film as a result of oxidation of the chromium. This oxide film is very hard to be reduced and cannot be reduced by an ordinary industrial furnace but can be reduced in a special industrial furnace at a temperature DP = −45° C. (1000° C.) or less. But, when the powder covered with such oxide film is held in a non-oxidizing atmosphere, even if the oxide film is not reduced, film cracks due to a difference in expansion coefficient between the film and the internal stainless steel and the aforesaid Ni-Mn and Cr-Ni powders are likely to be diffused into the stainless steel through the crack. To perform this, it is necessary that the dew point in the non-oxidizing atmosphere be at least −45° C. or lower, preferably, −50° C. The reason is that when the dew point is higher than −45° C., oxygen enters into the particle from the crack and combines with chromium in the ground of stainless steel.

Further, at least a Ni-Cr powder is mixed in the stainless steel powder along with the Ni-Mn powder and sintering of the powder mixture is started at a temperature raised up to the melting point of the Ni-Mn powder and terminated at a temperature in the vicinity of the melting point of the Ni-Cr powder. As is evident from the phase diagram of the Ni-Mn powder, its melting point is the lowest when the Ni content is 40% and melting point is 1018° C. Accordingly, mixing the Ni-Mn (Ni 40%, Mn 60%) powder in the stainless steel powder and sintering the powder mixture at 1020° to 1050° C., the alloy powder with the 40% Ni content is molten and diffused into the stainless steel particle from the aforesaid crack, and as the sintering proceeds, the liquid phase powder is also diffused into the Ni-Cr powder particle. As a consequence, the Ni-Cr powder is alloyed with the Ni-Mn powder and its composition changes. When the composition of the Ni-Cr powder thus alloyed with the Ni-Mn powder becomes the eutectic composition (Ni 50%, Cr 50%) or close thereto, the melting point lowers; for example, at a temperature in the vicinity of the eutectic temperature (1343° C.), the Ni-Cr powder is molten and sintered in liquid phase. The change in the composition of the Ni-Cr powder by the diffusion thereinto of the Ni-Mn powder need not always be made throughout the Ni-Cr powder; namely, it is sufficient that only one portion of the Ni-Cr powder is alloyed with the Ni-Mn powder and that the composition of the alloyed portion becomes close to the eutectic composition. The reason is that when melting of the portion of the eutectic composition is once started, the compositions of the other portions are also sequentially changed and they are molten as the sintering proceeds.

The stainless steel powder may be either the ferrite system or the austenite system, as referred to previously. Even in the stainless steel powder of the ferrite system, any of chromium, nickel and manganese has a certain degree of solid solubility with respect to the stainless steel powder. In the stainless steel powder of the austenite system, the abovesaid elements have sufficient solid solubility and the corrosion resistance of the sintered body can be further increased by adding them in suitable amounts.

It is also possible to add a sintering property improving component and a ground reinforcing component, as required, other than the Ni-Mn and Ni-Cr powders. For example, when copper or its alloy powder is added, it enhances the wetting property of the surface of the powder particle, during sintering, within the solid solubility limit of the copper, thus promoting the sintering of the powder. Further, since the melting point of the Cu-Mn powder is 868° C. in its eutectic composition, the sintering starts when the sintering temperature reaches 870° C. or so. With the copper content exceeding its solid solubility limit, however, copper is precipitated at the coupling portions of adjacent powder particles to degrade the corrosion resistance of the sintered body; accordingly, it is preferred that the copper content be smaller than 3% of the solid solubility limit.

In the case of sintering the stainless steel powder mixed with the Ni-Mn powder, for example, 52 to 54% of Mn and the remainder Ni and the Ni-Cr powder, the sintering is usually started at about 1000° C. and the sintering temperature is gradually raised and then the sintering is finished at 1200° to 1350° C. In such a case, the Ni-Mn powder is molten first and this liquid phase portion is diffused into the stainless steel powder particles and the Ni-Cr powder particles as the sintering proceeds, and when the sintering temperature reaches 1350° C. or so, the Ni-Cr powder starts to be molten and the liquid phase sintering proceeds, providing a porous body. For enhancement of the pore ratio of the porous body, it is preferred that the powder mixture is loosely packed into a required shape prior to sintering; but when the pore ratio need not be raised so high, the powder mixture may also be formed under a predetermined pressure prior to sintering. In such a case, since the powder mixture is pressed during the press forming, a dense sintered body is obtained. Also it is possible to fill voids of the sintered body with a lubricant and a material for increasing the bearing performance, such as a sulfide, oxide, metal, inorganic substance or organic substance; namely, the sintered body can also be used as a bearing and some other parts.

In the case of mixing the Ni-Mn or Ni-Cr powder in the stainless steel powder, it is preferred that the particle of the Ni-Mn or Ni-Cr powder is smaller than the stainless steel powder particle which frames the porous sintered body. To this end, the particle size of the stainless steel powder is usually adjusted to range from 20 to 100 meshes and, in this case, it is desirable that the particle size of the Ni-Mn or Ni-Cr powder is adjusted to be less than 100 meshes. Furthermore, the mixing ratios of the Ni-Mn and the Ni-Cr powder to the stainless steel powder can be determined in accordance with the pore ratio and the alloy composition of the porous body desired to obtain, but it is usually preferred that the Ni-Mn powder in the range of 5 to 10% and the Ni-Cr powder in the range of 5 to 20%.

Although in the foregoing the stainless steel powder is sintered without any pretreatment, it is desirable to subject the stainless steel powder to preheat treatment to lower its hardness before being mixed with the Ni-Cr or Ni-Mn powder. In the case of sintering the powder mixture into a porous body after press-forming the powder mixture into a required configuration, a very large pressure is required for the press-forming of the powder mixture since the hardness of the stainless steel powder is very large; but when the hardness of the stainless steel powder is reduced by the preheat treatment, the pressure for the press-forming may be very small, allowing much ease the manufacture of porous bodies.

The present invention will be further described in connection with its examples.

EXAMPLE 1

A ferrite system stainless steel powder (with a mean particle size of 70 meshes) consisting of 0.2 wt % of CO, 0.9 wt % of Si. 0.1 wt % of Mn, 17.5 wt % of Cr, 1 wt % of Mo and the balance Fe was mixed with a Ni-Mn powder (with a mean particle size of 150 meshes) consisting of 60 wt % of Mn and 40 wt % of Ni and a Ni-Cr powder (with a mean particle size of 150 meshes) consisting of 40 wt % of Ni and 60 wt % of Cr in the ratio of 80 to 10 to 10 by weight. Then, the powder mixture was loosely packed in a heat-proof vessel, which was placed in a furnace under non-pressure condition. In the furnace the dew point of the atmosphere was −45° C. and the powder mixture packed in the vessel was sintered at 1200° C. for 60 minutes, gradually raising the sintering temperature from 1050° C.

As a result of this, a porous body of stainless steel was obtained and its pore ratio was about 50%. It was found that, during the sintering, Ni, Cr and Mn were diffused into the ground of the stainless steel powder particle.

EXAMPLE 2

An austenite system stainless steel powder (with a mean particle size of 70 meshes) consisting of 0.2 wt % of CO, 0.9 wt % of Si, 0.2 wt % of Mn, 10.5 wt % of Ni, 19 wt % of Cr and the balance Fe was mixed with a Ni-Cr powder (with a mean particle size of 150 meshes) consisting of 50 wt % of Ni and 50 wt % of Cr, a Ni-Mn powder (with a mean particle size of 150 meshes) consisting of 60 wt % of Ni and 40 wt % of Mn and a Mn-Cu powder consisting of 35 wt % of Mn and 65 wt % of Cu in the ratio of 90 to 5 to 2.5 to 2.5 by weight. Then, the powder mixture was packed in a heat-proof vessel, which was placed in a furnace under non-pressure condition. In the furnace the dew point of the atmosphere was −45° C. and the powder mixture packed in the vessel was sintered at 980° C. for 30 minutes first and then further sintered at 1350° C. for an hour. In this example, at 980° C., the Cu-Mn powder was molten and precipitated on the stainless steel powder particle; at about 1020° C., the Ni-Mn powder was molten; at 1340° C., the Ni-Cr powder was molten; and at 1350° C., the sintering was completely finished. A porous body (with a pore ratio of 30 wt %) was obtained.

EXAMPLE 3

The same powder mixtures as used in Examples 1 and 2 were prepared. During the preparation about 1 wt % of zinc stearate was added to each of them. Prior to the preparation of each powder mixture, the stainless steel powder was heat treated to reduce its hardness to $H_{RC}$ 40 or so. The both powder mixtures was sintered after being pressed under a pressure of 7 tons/cm$^2$. The sintering conditions were the same as those employed in Examples 1 and 2, respectively. In this Example low melting alloy was disappeared and porous bodies were obtained.

As has been described in detail in the foregoing, according to the present invention, a stainless steel powder is mixed with at least a Ni-Mn and a Ni-Cr powders and the powder mixture is sintered under non-pressure condition, so that the sintering may be performed at a relatively low temperature and in a short time, and in addition, a porous body of excellent mechanical properties, corrosion resistance and heat resistance can be obtained. It is also possible to sinter the powder mixture after pressing it into a required shape; in this case, a porous body which disappeared low melting alloy can easily be obtained.

Although the foregoing description has been given on the assumption that particle of the stainless steel powder is spherical, the particle need not always be spherical but may also be irregular-shaped one such as a rod-like one and similar configurations.

It will be apparent that many modifications and variations may be effected without departing from the scope of the novel concepts of this invention.

What is claimed is:

1. A method for manufacturing a porous sintered stainless steel body comprising the steps of:

(a) forming a mixture comprising stainless steel powder, Ni-Mn powder and Ni-Cr powder, wherein the particles of the Ni-Mn powder and the Ni-Cr powder are smaller than the particles of said stainless steel powder;

(b) pouring the resulting powder mixture of step (a) into a heat-proof vessel without applying any pressure to said mixture;

(c) sintering said mixture poured into said heat-proof vessel of step (b) under a non-oxidizing atmosphere without applying any pressure to said mixture such that said sintering is started at about at least 1000° C. with the temperature gradually being raised and said sintering is finished at 1200° C. to 1350° C.

* * * * *